US005616270A

United States Patent [19]

Park

[11] Patent Number: 5,616,270

[45] Date of Patent: Apr. 1, 1997

[54] MICROWAVE OVEN HAVING A LAMP AND DOOR-OPERATED SWITCH MOUNTED ON A CIRCUIT BOARD

[75] Inventor: Byeng-Jun Park, Suwon, Rep. of Korea

[73] Assignee: Samsung Electronics Co., Ltd., Suwon, Rep. of Korea

[21] Appl. No.: 393,810

[22] Filed: Feb. 24, 1995

[30] Foreign Application Priority Data

Feb. 25, 1994 [KR] Rep. of Korea ..... 94-3497

[51] Int. Cl.[6] ..... H05B 6/68

[52] U.S. Cl. ..... 219/722; 219/720; 219/724; 219/758; 362/92

[58] Field of Search ..... 219/722, 723, 219/724, 758, 720; 362/92

[56] References Cited

U.S. PATENT DOCUMENTS 5,373,142 12/1994 Ohshima et al. ..... 219/720

FOREIGN PATENT DOCUMENTS 63-264891 11/1988 Japan ..... 219/722
1-117292 5/1989 Japan ..... 219/722
1-227389 9/1989 Japan ..... 219/722

*Primary Examiner*—Philip H. Leung
*Attorney, Agent, or Firm*—Burns, Doane, Swecker & Mathis, L.L.P.

[57] ABSTRACT

A microwave oven includes a cooking chamber closed by a door. The magnetron is operated by a control mechanism which includes a circuit board and safety switches which permit the magnetron to be operated only when the door is closed. The opening and closing of the door causes a switch-actuating mechanism to be operated for turning the safety switches on or off. The safety switches, together with a lamp for illuminating the cooking chamber, are mounted on the circuit board. The circuit board is arranged horizontally, with the switches and lamp being mounted on a bottom surface thereof.

3 Claims, 8 Drawing Sheets

MICROWAVE OVEN HAVING A LAMP AND DOOR-OPERATED SWITCH MOUNTED ON A CIRCUIT BOARD

BACKGROUND OF THE INVENTION

1. Field of the Invention

The present invention relates to a microwave oven, and more particularly to a microwave oven adapted to be disposed with a circuit board to a switch body for being opened and closed by an open/close operation of a door, so that a simplified assembly structure of a driving switch on the microwave oven can increase a productivity thereof and improve a reliability of the product.

2. Description of the Prior Art

Generally, a microwave oven includes as illustrated in FIG. 7, a body 101 provided with a heating chamber 101*a* adapted to open forwards and an electric component chamber 101*b* provided with various electric components and switches, and a door 102 being hinged at one side of the body 101 to thereby close and/or open the heating chamber 101*a*.

The door 102 is provided at one end portion thereof with a latch 103, and the component chamber 101*b* is provided at a front portion of one side thereof with a switch unit 104 for receiving the latch 103 and containing a plurality of switches operated by the latch 103.

Furthermore, the component chamber 101*b* is provided at a front surface thereof with a circuit board 105, which is in turn provided at a front surface thereof with a display unit (not shown) constituting liquid crystal display elements.

A lamp 105*a* is separately disposed therefrom, thereby illuminating an interior of the heating chamber 101*a*.

As illustrated in FIG. 8, the latch 103 constitutes an upper latch 103*a* and a lower latch 103*b* separated by a predetermined interval, and the switch unit 104 includes a second safety switch 107 for being mounted at an upper side of a body 106 and for being operated by the upper latch 103*a*, a monitor switch 108 for being provided at a lower side of the body 106 and for being operated by the lower latch 103*b*, and a first safety switch 109.

The monitor switch 108 is operated through the intermediary of a first operating member 108*a* adapted to rotate according to operation of the lower latch 103*b*, and the first safety switch 109 is operated through the intermediary of a second operating member 109*a*.

These switches 107, 108 and 109 are separately mounted in the body 106 in order to perform systematic and foolproof operation and are disposed at the same time in such a state as to be disposed in a clip 106*a* formed on the body 106*a*.

In the operation of the switches, as the door 102 is closed, the first operating member 108*a* is rotatively moved by the lower latch 103*b*, thereby moving the monitor switch 108, so that a closed circuit is formed.

Meanwhile, the latch 103 is resiliently lowered by a spring (not shown), so that the second safety switch 107 is closed by the latch 103*a* continuously soon after the aforesaid operation, and at the same time, the lower latch 103*b* rotatively moves the second operating member 109*a*, thereby closing the first safety switch, so that a normal circuitry can be constituted.

When the door 102 is opened, the monitor switch 108 is closed in contrast to the above operation and the first safety switch 109 and the second safety switch 108 are opened, thereby preventing the high frequency energy from being discharged.

In the conventional microwave oven structured as above, there is a problem in that the switches are separately mounted in the switch unit, and at the same time, are arranged within the body by the clip, so that production of the switch unit is difficult and cannot be easily performed by automated equipment.

Furthermore, there is another problem in that the spacing apart of the switches, and the lamp adapted requires a number of long and associated wiring works for electrically connecting the same.

Therefore, the present invention is intended to solve the aforementioned problems, and it is an object of the present invention to provide a microwave oven provided with a switch arrangement for more reliably controlling a high frequency oscillation.

It is another object of the present invention to provide a microwave oven in which associated wirings for electrically connecting the switches to the lamp for controlling the high frequency oscillation can be eliminated.

It is still another object of the present invention to provide a microwave oven which makes it easier for components to be mounted by automated equipment.

In accordance with the object of the present invention, there is provided a microwave oven, the oven comprising: a housing for forming a cooking chamber a door for opening and/or closing the cooking chamber; high frequency generating means for generating a high frequency so that the high frequency can be irradiated to the food in the cooking chamber; a circuit board for operating the high frequency generating means; and switching means for switching supply of voltage from an alternating current AC power source to the circuit board so that generation of high frequency from the high frequency generating means can be controlled according to the opening and/or closing of the door.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENT OF THE INVENTION

Figure 1:
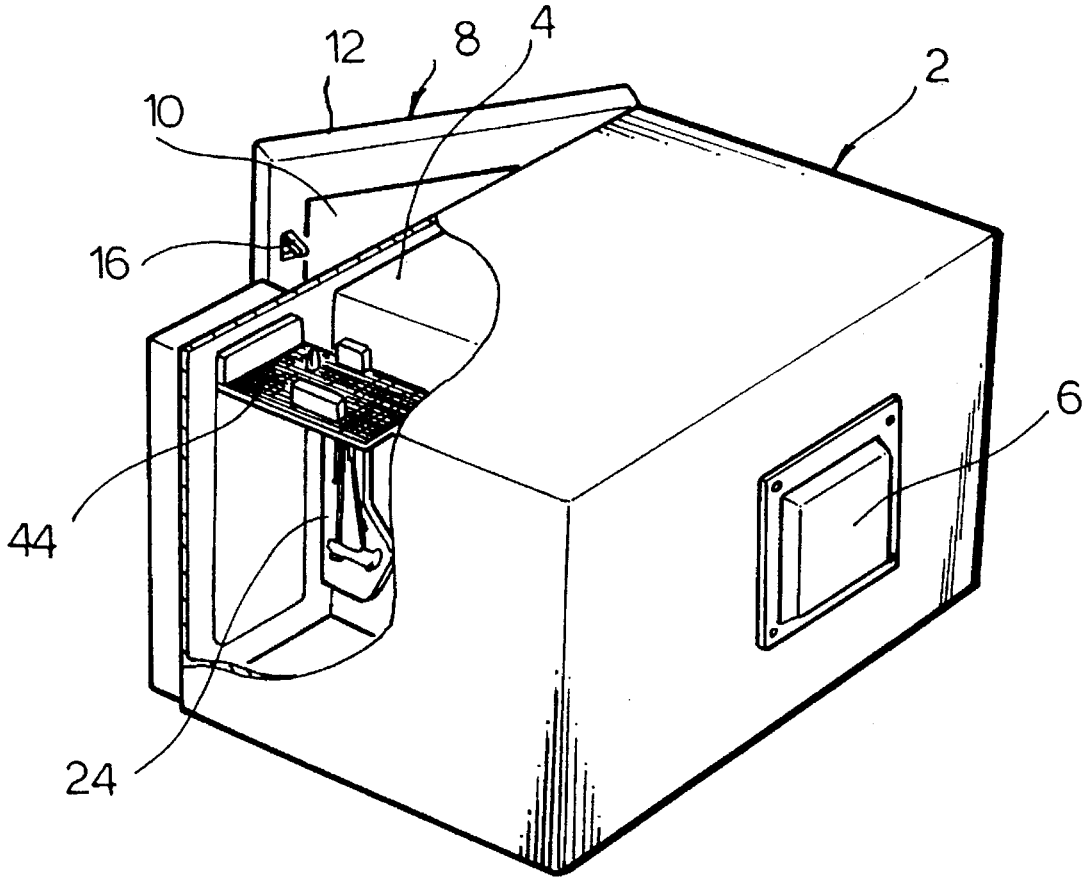
FIG. 1 is a perspective view partially broken away for illustrating a portion of a microwave oven according to an embodiment of the present invention.

A preferable embodiment of the present invention will now be described in detail with reference to the attached drawings.

As will become apparent from the following description, a microwave oven is provided in which operating switches 26, 28, 30 and a lamp 46 are mounted on a circuit board 44 in order to reduce the need for wires, and to facilitate production. Those switches are actuated by an actuating mechanism 16, 24 which is responsive to the closing and opening of the oven door.

A cooking chamber 4 is formed in a housing 2 as illustrated in FIGS. 1 to 5.

A display plate 6 is screwed to a rear surface of the housing 2 where the plate 6 displays a rated voltage, rated current and manufactured date of the microwave oven.

A door 8 for opening and/or closing the cooking chamber 4 includes a window 10 for exposing the cooking chamber 4, a second housing 12 for supporting the window 10, locking/operating means 16 for being disposed in the second housing 12 to thereby lock the door 8 and to operate switching means (described later), and a spring 18 for biasing the locking/operating means 16 downwardly so that a second cam and a third cam of the switching means (described later) can be operated by the locking/operating means 16.

The locking/operating means 16 is constituted by an upper latch 20 and a lower latch 22 protruded from the door 8 in order to rotate first, second and third cams of the switching means (described later).

The switching means 24 is provided in the housing 2 for containing the application of the voltage from the AC power source to a circuit board (described later) which operates the high frequency generating means (described later) according to the opening and/or closing of the door 8.

The switching means 24 includes (i) a first switch 26 and a second switch 28 for being turned off as the door 8 is opened so that the high frequency cannot be generated from the high frequency generating means and for being turned on when the door 8 is closed so that the voltage can be applied to the high frequency generating means, (ii) a monitor switch 30 for being activated when the door 8 is opened so that generation of high frequency from the high frequency generating means can be prevented and for being deactivated when the door 8 is closed so that the voltage can be applied to the high frequency generating means, (iii) first, second and third cams 32, 34 and 36 for being rotated by movement of the upper latch 20 and the lower latch 22, (iv) a first lever 38 for performing a rectilinear motion according to rotation of the first cam 32 to thereby turn on and turn off the first switch 26, (v) a second lever 40 for performing a rectilinear motion according to rotation of the second cam 34 to thereby turn on and turn off the second switch 28, and (vi) a third lever 42 for performing a rectilinear motion according to rotation of the third cam 36 to thereby turn on and turn off the monitor switch 30.

The first switch 26 is provided with a contact terminal 26*a* adapted to be pressed by the first lever 38.

The second switch 28 is disposed with a contact terminal 28*a* adapted to be pressed by the second lever 40, and the monitor switch 30 is provided with a contact terminal 30*a* adapted to be pressed by the third lever 42.

The circuit board 44 for operating the high frequency generating means (described later) is horizontally disposed within the housing 2 in order to integrally connect the same with the switching means 24.

Figure 2:
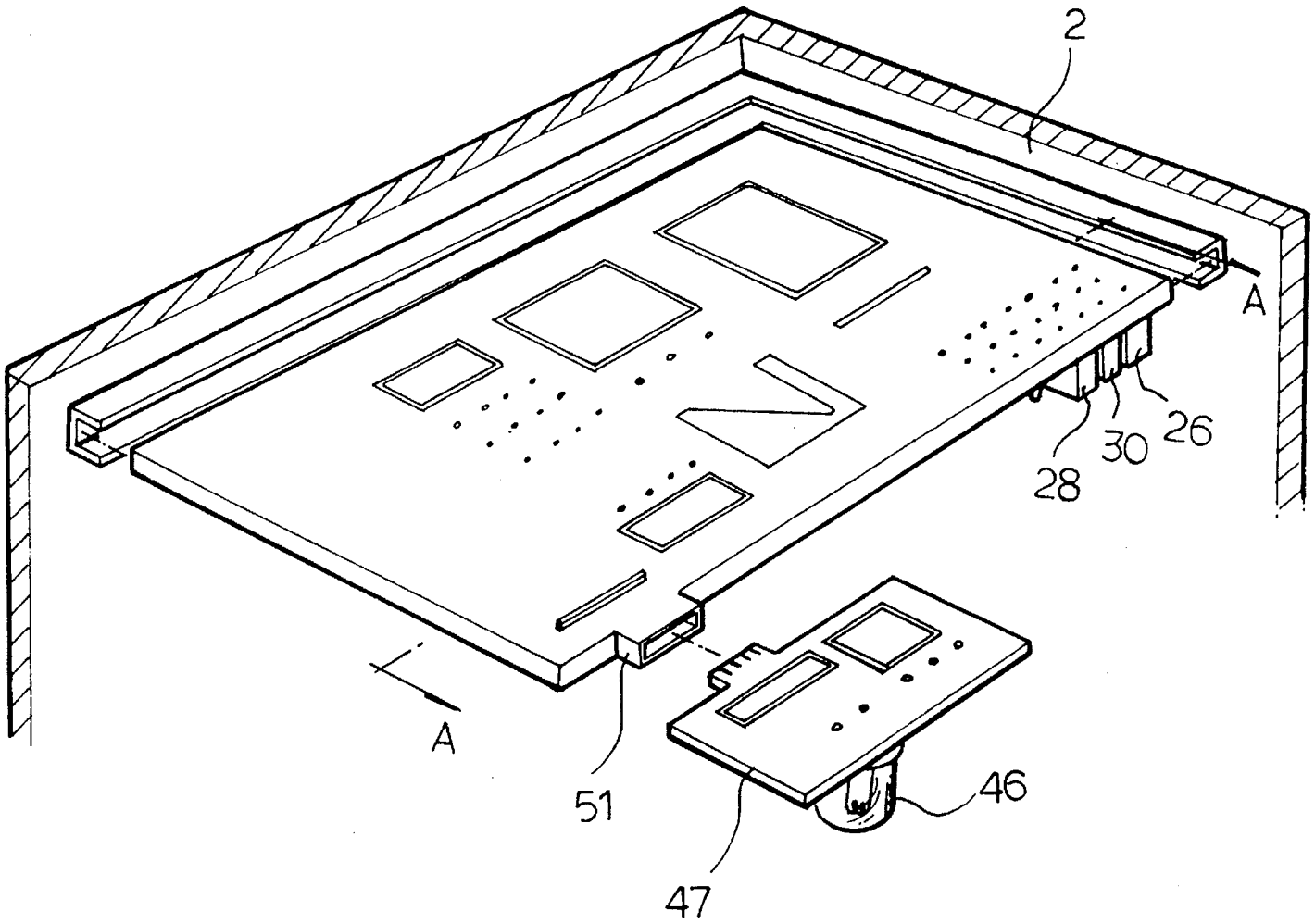
FIG. 2 is a perspective view for illustrating a circuit board and a housing in a microwave oven according to the embodiment of the present invention.

The first, second and monitor switches 26, 28 and 30 are welded to the circuit board 44, which is releasably assembled to the housing 2 by an L-shape rail 43 as illustrated in FIG. 2.

The circuit board 44 is connected to a lamp 46 for illuminating the interior of the cooking chamber 4 so that a user can check state of the food in the cooking chamber.

Figure 6:
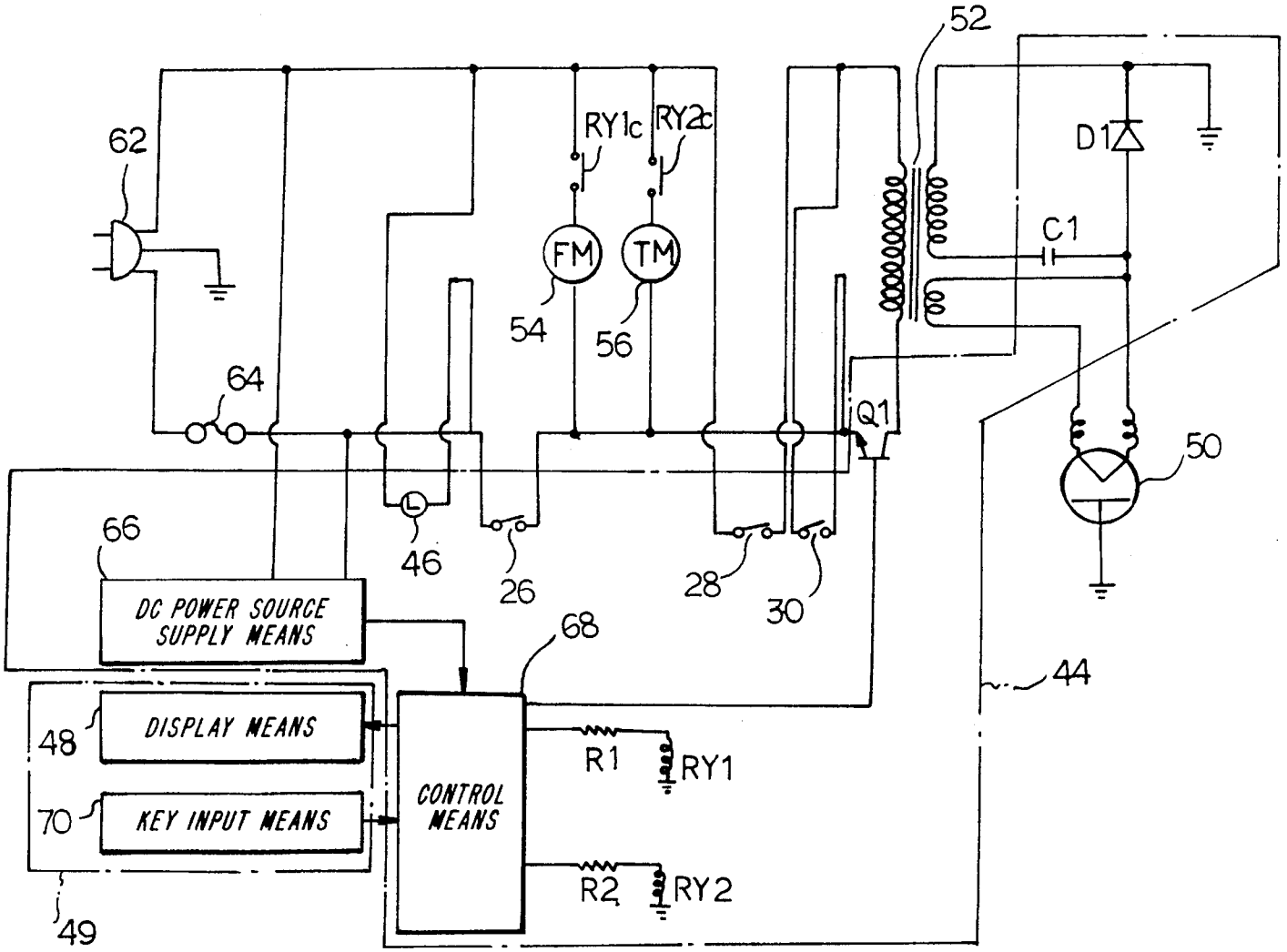
FIG. 6 is a circuit diagram of the microwave oven according to the embodiment of the present invention.
Figure 7:
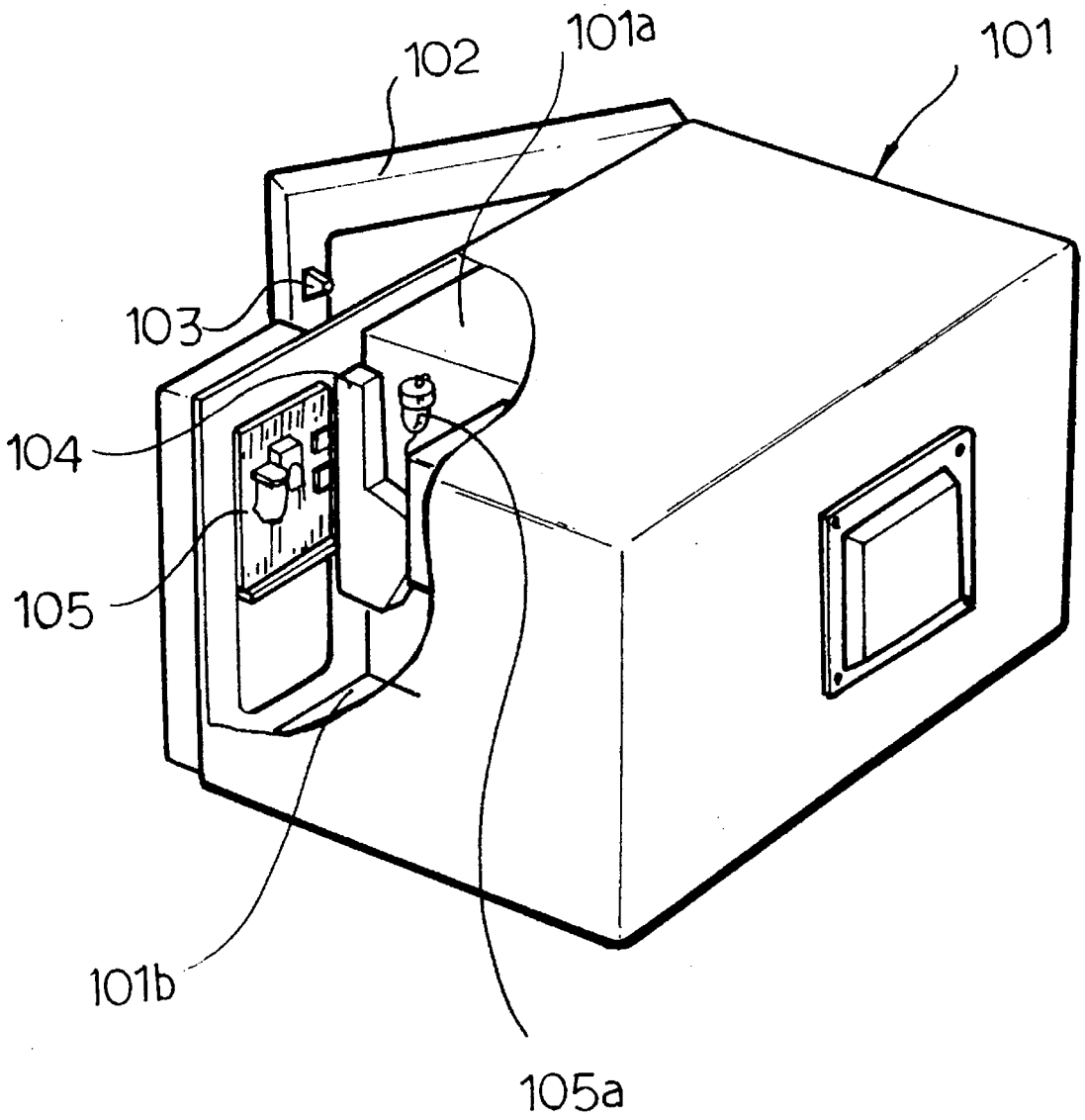
FIG. 7 (Prior Art)
FIG. 7 is a perspective view partially broken away for illustrating a portion of a conventional microwave oven.
Figure 8:
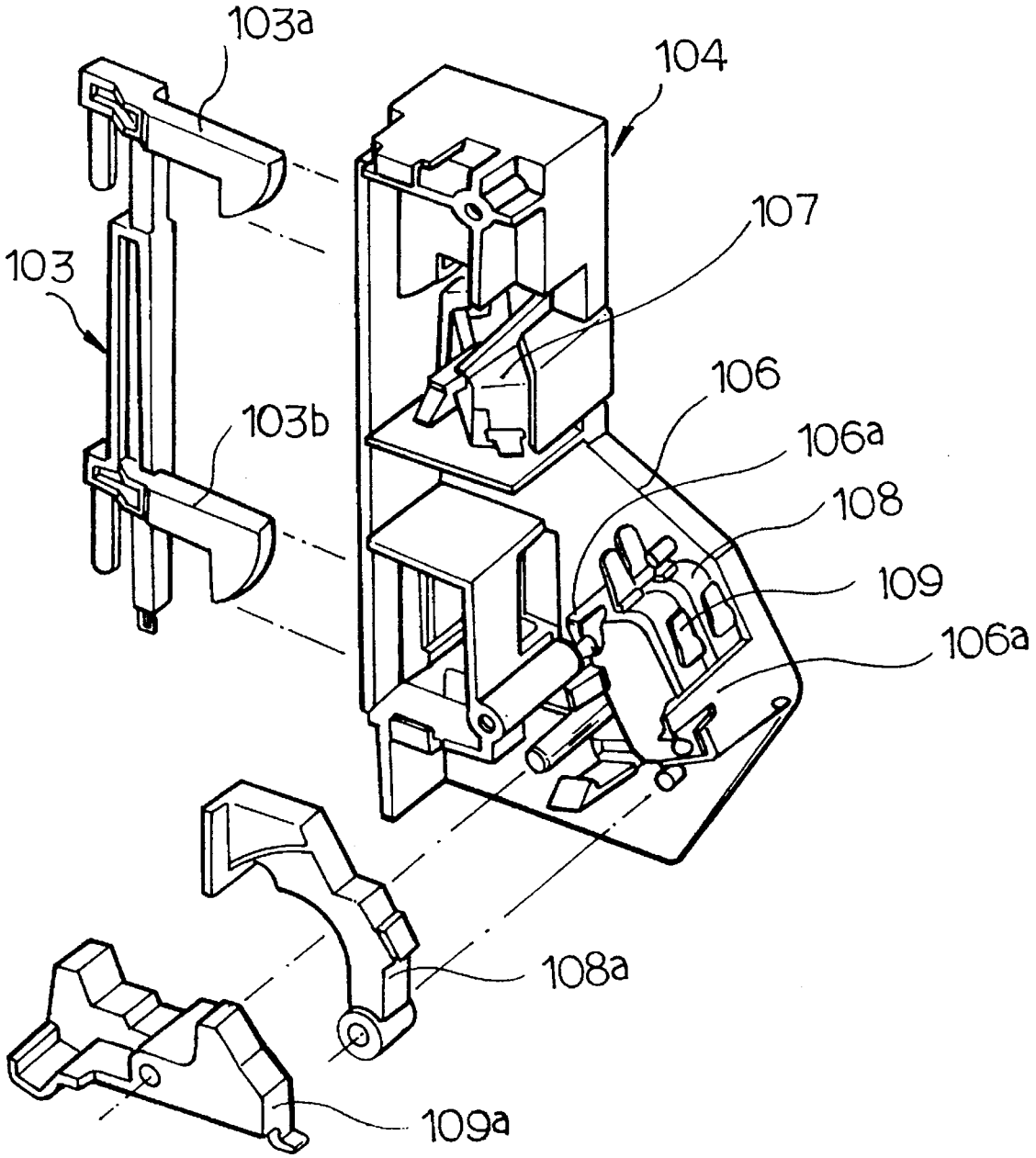
FIG. 8 (Prior Art)
FIG. 8 is an exploded perspective view of a switch unit of the conventional microwave oven.

The lamp 46 is connected to the circuit board through the intermediary of a second circuit board 47 and a connector The circuit board 44, as illustrated in FIG. 6, is connected to an operation panel 49 comprising display means 48 for displaying an operation command of the user and cooked state of the food and key input means 70 for inputting the operation command of the user.

The high frequency generating means 50 for generating the high frequency in order to irradiate the same on the food in the cooking chamber 4 is a magnetron.

The circuit board 44 includes a high voltage transformer 52 for receiving an alternating current of 200 amp from the AC power source 62 to thereby generate an AC voltage of 2,100 V, and a high voltage diode D1 for receiving the AC voltage of 2,100 V from the high voltage transformer 52 to thereby generate a direct current DC voltage of 4,200 V to the high frequency generating means 50, and a high voltage capacitor C1.

The high voltage transformer 52 is connected at a primary side thereof to a fan motor 54 for cooling the high frequency generating means 50 and a turntable driving motor 56 for rotating the food inside the cooking chamber 4.

Reference numeral 68 in FIG. 6 denotes control means for controlling an overall operation of the microwave oven and reference numeral 64 is a fuse. Reference symbol RY1 represents a relay for operating the fan motor 54 according to a control of the control means 68. Reference symbol RY1c denotes a contact of the relay RY1, and RY2 represents a relay for operating the turntable motor 56 according to the control of the control means 68. Reference symbol RY2*c* denotes a contact of the relay RY2. Reference symbol Q1 represents a transistor.

Now, the operation of the microwave oven according to the embodiment of the present invention thus structured will be described.

First of all, it is assumed that the door 8 is open as an initial condition to explain the operation of the microwave oven.

When the door is open, the first switch 26 and the second switch 28 are turned off while the monitor switch 30 is turned on.

Next, the user puts the food on the turntable in the cooking chamber 4, and pushes the door 8 toward the housing 2 in order to close the door 8.

Figure 4:
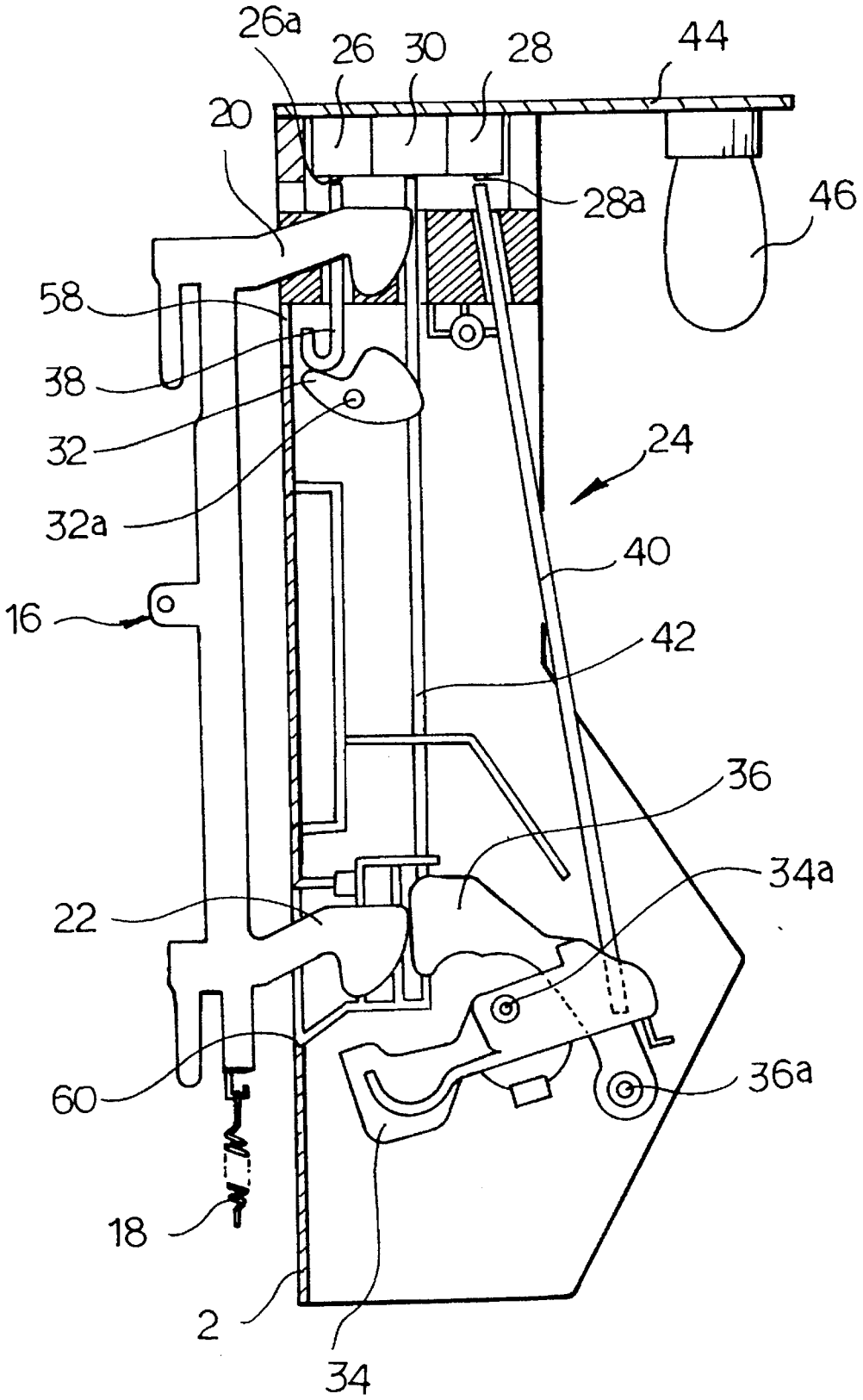
FIG. 4 is a sectional view along line 3—3 in FIG. 2 in an initial state where the door is partially closed.

Then, as illustrated in FIG. 4, the upper latch 20 and the lower latch 22 at the door 8 enter into grooves 58 and 60 of the housing 2.

The third cam 36 now rotates clockwise around a hinge 36*a*, and then the third lever 42 moves upwards to thereby press the monitor switch 30. The monitor switch 30 is in turn rendered deactivated.

Figure 5:
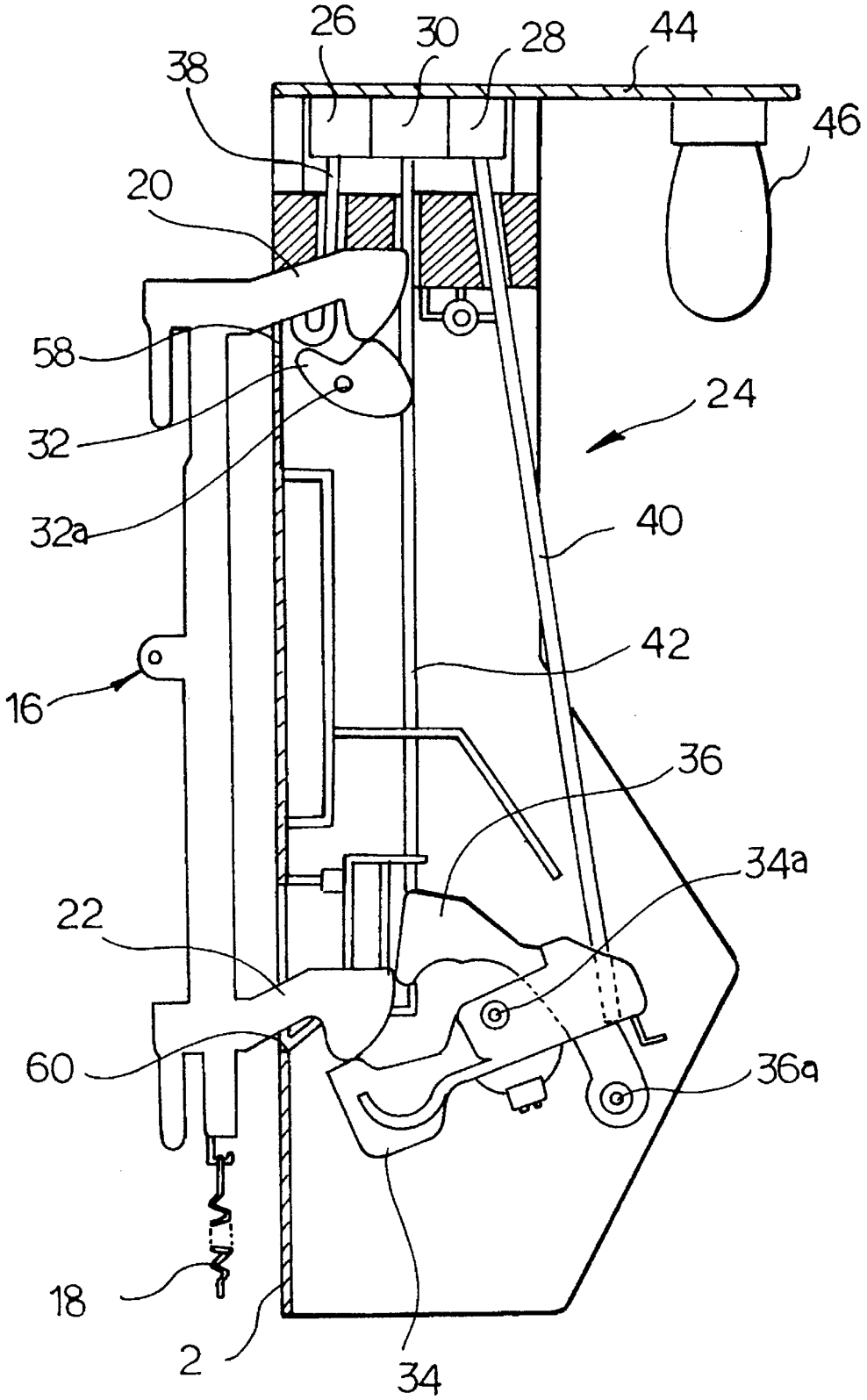
FIG. 5 is a sectional view along line 3—3 in FIG. 2 in a state where the door is fully closed.

When the upper latch 20 and the lower latch 22 fully enter into the grooves 58 and 60, the locking/operating means 16 moves downwards under the influence of the spring 18 as illustrated in FIG. 5.

Next, the first cam 32 is rotated clockwise around a hinge 32*a* by the upper latch 20, and the second cam 34 is rotated counterclockwise around a hinge 34*a* by the lower latch 22.

The first lever 38 then moves upwards to thereby turn on the first switch 26 and at the same time, the second lever 40 moves upwards to thereby turn on the second switch 28.

As described above, the high frequency generating means 50 can now be operatively driven so that the cooking desired by the user is possible by way of activating and/or deactivating operation of the three switches 26, 28 and 30, in the same way as a driving circuit of a microwave oven having a conventional three-switch system.

Meanwhile, when the food is cooked, the user pulls the door 8 from the housing 2 in order to open the door 8.

Then, as illustrated in FIG. 4, the upper and lower latches 20 and 22 are moved outside of the housing 2. The locking/operating means 16 now moves upwards by way of a release button (not shown) disposed under the operating panel 49.

The first cam 32 is rotated counterclockwise around the hinge 32*a* by way of a resilient force previously applied thereto.

When the first cam 32 is rotated counterclockwise around the hinge 32*a*, the first lever 38 moves downwards to thereby turn off the first switch 26. At the same time, the second cam 34 is rotated clockwise around the hinge 34*a* by way of a resilient force previously applied thereto. When the second cam 34 is rotated clockwise around the hinge 34*a*, the second lever 40 moves downwards to thereby turn off the second switch 28.

Figure 3:
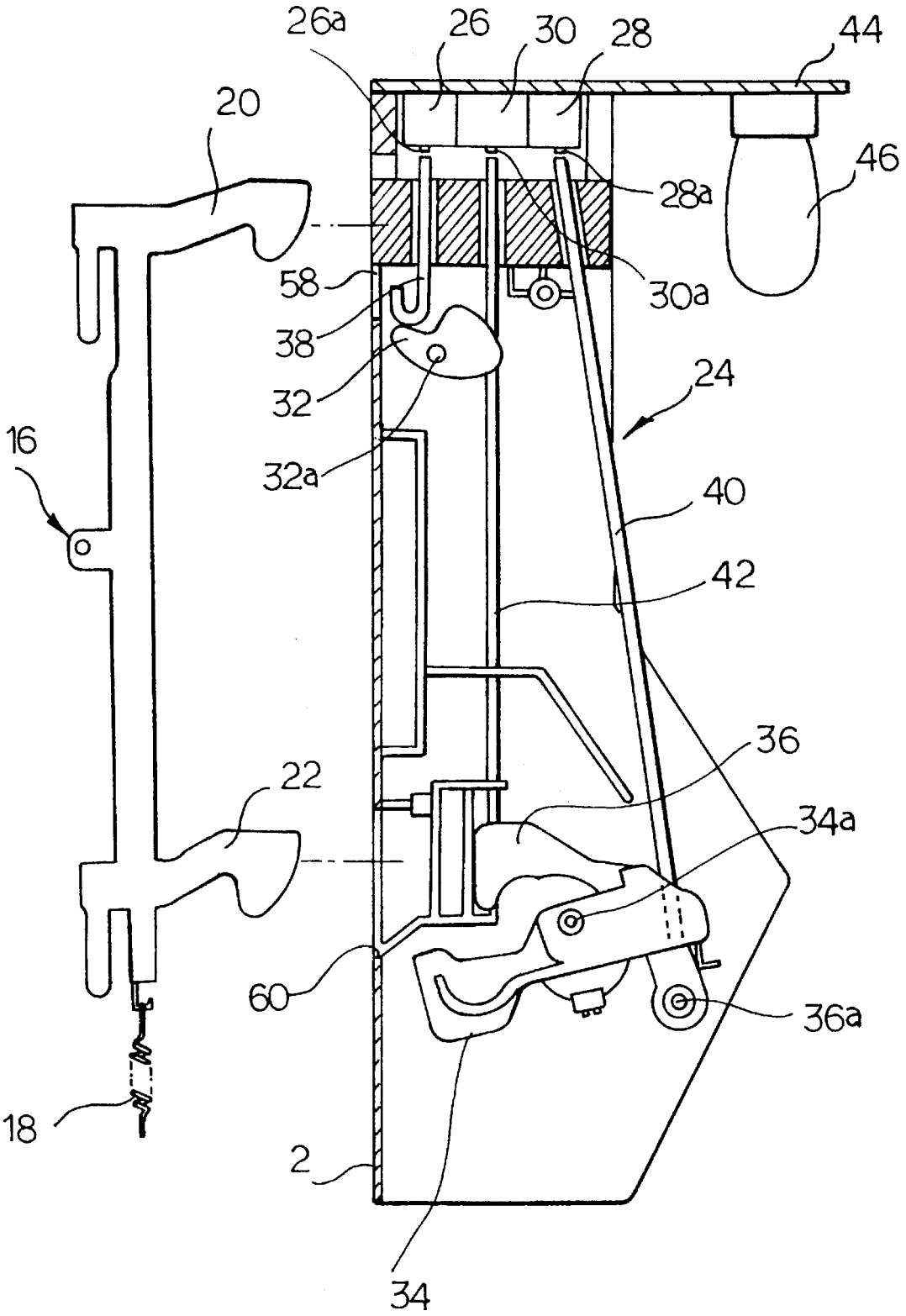
FIG. 3 is a sectional view along line 3—3 in FIG. 2 in a state where a door is opened.

As illustrated in FIG. 3, when the door 8 is completely opened, the third cam 36 is rotated counterclockwise around the hinge 36*a* by way of a resilient force previously applied thereto, thus the third lever 42 moves downwards to thereby activate the monitor switch 30.

Meanwhile, when the user opens the door 8 in the midst of cooking of the food, the first and second switches 26 and 28 are turned off through the aforesaid processes which also turn on the monitor switch 30.

Accordingly, the user can be safe because the voltage is not applied to the high frequency generating means 50 to thereby prevent the high frequency generating means 50 from generating the high frequency.

As apparent from the foregoing, according to the microwave oven of the present invention, there is an excellent advantage in that a switches for controlling a high frequency oscillation and a lamp are mounted on a circuit board to thereby simplify assemblage, and the structure of the oven is simplified because of the elimination of associated wirings for the switch and the lamp.

Furthermore, there is another advantage in that the attachment of the switches to a circuit board can be performed by automated equipment.

Having described specific preferred embodiments of the invention with reference to the accompanying drawings, it is to be understood that the invention is not limited to those precise embodiments, and that various changes and modifications may be affected therein by one skilled in the art without departing from the scope or spirit of the invention as defined in the appended claims.

What is claimed is:

1. A microwave oven comprising:

a housing forming a cooking chamber;

a door mounted on the housing for opening and closing the cooking chamber;

a high frequency generator mounted in the housing for generating high frequency cooking waves directed to the cooking chamber;

a control mechanism for controlling operation of the generator, including a circuit board having a switch mounted thereon in electrical connection with a circuit path thereof, and being electrically connected to the generator for preventing operation thereof while the door is open, the circuit board being oriented substantially horizontally at an upper portion of the housing, and a switch actuating mechanism including a first portion mounted on the door, and a second portion mounted on the housing, the second portion arranged to be operated by the first portion in response to closing of the door, and positioned to actuate the switch when operated by the first portion; and a lamp for illuminating the cooking chamber, the lamp being mounted on the circuit board in electrical connection with the circuit path thereof, wherein the switch constitutes a first switch, the control mechanism further including a second switch mounted on the bottom surface of the circuit board in electrical connection with the circuit path thereof, the first and second switches arranged for being turned off when the door is open to prevent the generation of high frequency waves, and for being turned on when the door is closed to permit the generation of high frequency waves; the control mechanism further comprising a monitor switch arranged for being turned on when the door is opened to prevent the generation of high frequency waves, and for being turned off when the door is closed to permit the generation of high frequency waves, the monitor switch being mounted on the bottom surface of the circuit board in electrical connection with the circuit path thereof, the switch actuating mechanism being disposed beneath the circuit board, wherein the first portion of the switch actuating mechanism comprises upper and lower latches; the second portion of the switch actuating mechanism comprising first, second and third cams and first, second and third levers arranged to be displaced linearly in response to rotation of the first, second and third cams, respectively, for turning on or turning off the first switch, the second switch and the monitor switch, respectively; the first cam being rotatable by the upper latch; and the second and third cams being rotatable by the lower latch.

2. The microwave oven according to claim 1, wherein the door comprises a frame containing a window for exposing the cooking chamber, the first portion of the switch-actuating mechanism disposed in the frame and being spring-biased downwardly.

3. The microwave oven according to claim 1 wherein the circuit board comprises first and second sections releasably electrically interconnected, the switch and lamp being mounted on the first and second sections, respectively.

* * * * *